United States Patent [19]

Scarlata

[11] Patent Number: 4,606,483

[45] Date of Patent: Aug. 19, 1986

[54] BOOTGRIPPER

[76] Inventor: Salvatore Scarlata, 101-02 95th Ave., Queens, N.Y. 11209

[21] Appl. No.: 716,557

[22] Filed: Mar. 27, 1985

[51] Int. Cl.[4] ..... A47J 51/02

[52] U.S. Cl. ..... 223/119

[58] Field of Search ..... 223/118, 119; D7/105; 294/28, 99.2, 117

[56] References Cited

U.S. PATENT DOCUMENTS

| | | | |
|---|---|---|---|
| 72,144 | 12/1867 | Winans | 223/119 |
| 252,025 | 1/1882 | Fellows | 294/28 X |
| 703,310 | 6/1902 | Schneider | 223/119 |
| 1,862,680 | 6/1932 | Hutchison | 294/28 |
| 2,784,024 | 3/1957 | Edgerton | 294/28 X |
| 3,501,073 | 3/1970 | Breithor | 223/118 |

*Primary Examiner*—Robert R. Mackey

*Attorney, Agent, or Firm*—Peter L. Berger

[57] ABSTRACT

A bootgripper is disclosed which is formed of articulated T-shaped members. A handle portion is formed of such a T-shaped member which is grippable by the fingers to urge a pair of opposing jaw members against the rear surface of a boot and to fixedly be held in that position under positive pressure between the head of the T-shaped handle and one portion of one of the jaws of the gripping device.

7 Claims, 2 Drawing Figures

BOOTGRIPPER

BACKGROUND OF THE INVENTION

This invention relates to a device which assists in helping to pull a boot onto the foot of the user, and more particularly, to such a device which may be conveniently used and stored.

Pulling on boots is often a difficult and arduous task. The user tends to grab the top edge of the boot, and frequently that comes loose as the boot is pulled on. Boots come in varying heights, and the difficulties one encounters in pulling on boots is legion.

An object of this invention is to provide a device to assist in the pulling on of boots, yet providing such a device of materials which will lend the device to easy manufacture and minimum cost.

Another object of this invention is to provide such a device which is very easy to use, is small and compact and can be easily stored.

Another object of this invention is to provide such a gripper which may be simple to use and effective in operation.

Still another object of this invention is to provide such a device which is durable, is made of sturdy components and is susceptible to long use.

Yet another object of this invention is provide such a gripper device which may be easily manually gripped and used during operation, yet which may allow for easy release from the boot surface once the boot is slipped on.

Other objects, advantanges and features of this invention will become apparent hereinafter.

SUMMARY OF THE INVENTION

In accordance with the principles of this invention, the above objects are accomplished by providing a boot clamp or gripper assisting in the pulling on of boots, the grapper or gripper comprising three elements, the first element being a handle of a T-shape, the second element comprising a first jaw member, while the third element comprises a second jaw member. The three members are articularly joined as by suitable hinge members to enable the gripper to assume two positions, one of the positions being a release position in which the boot may be removed from the gripper or inserted between the jaws, while the second position is a tightened position in which the boot is maintained under tension between the gripping surfaces allowing the gripper to be attached to the boot enabling the handle to pull the boot upwardly as it is being pulled onto the foot of the user.

The first and second jaw members comprise cooperative projecting tips and concave surfaces between which the top edge of the boot is inserted, and when in this position, the boot may be grasped by the gripper being moved to the tighten position maintaining the boot surface under tension between the jaws.

THE DETAILED DESCRIPTION

Figure 1:
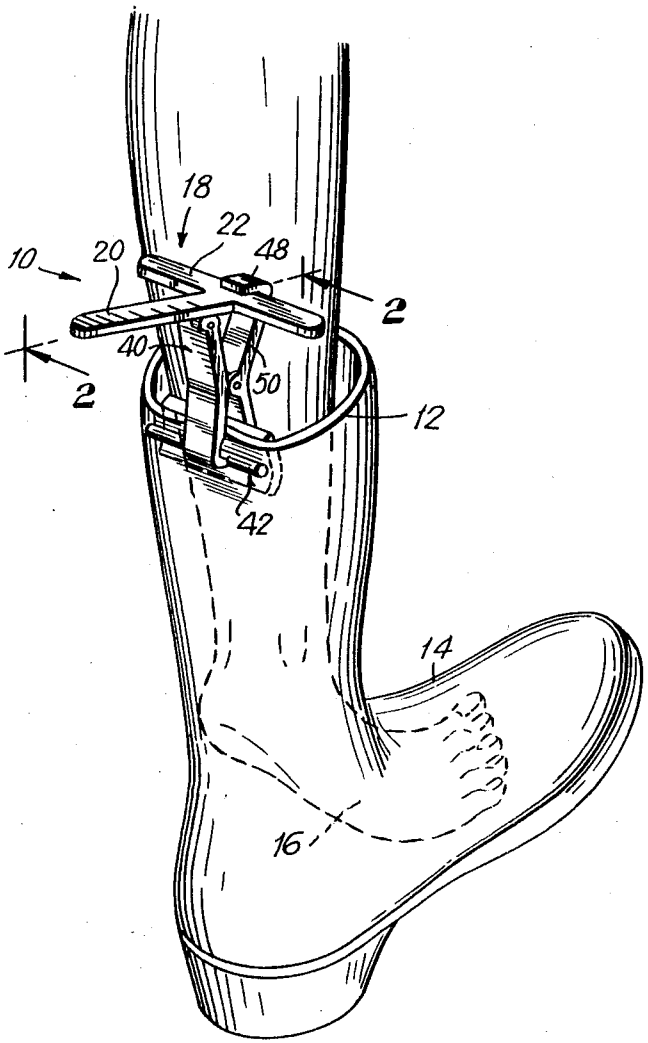
FIG. 1 is a perspective view of this invention showing the gripper attached to a boot.

FIG. 1 is a perspective view of the gripper or clamp shown generally with the numeral 10 attached to the top edge surface 12 of a boot 14 into which the foot 16 of a user is being inserted. The gripper 10 serves as an extension of the top rear edge of the boot to make the boot more accessible during the insertion process. Alternatively, the clamp may attach to the side edges of the boot. Although a single gripper or clamp is shown in FIG. 1 attached to the rear of the boot, two grippers could be used simultaneously on opposite side edges of the top of the boot to further assist in the pulling on of the boot 14.

Figure 2:
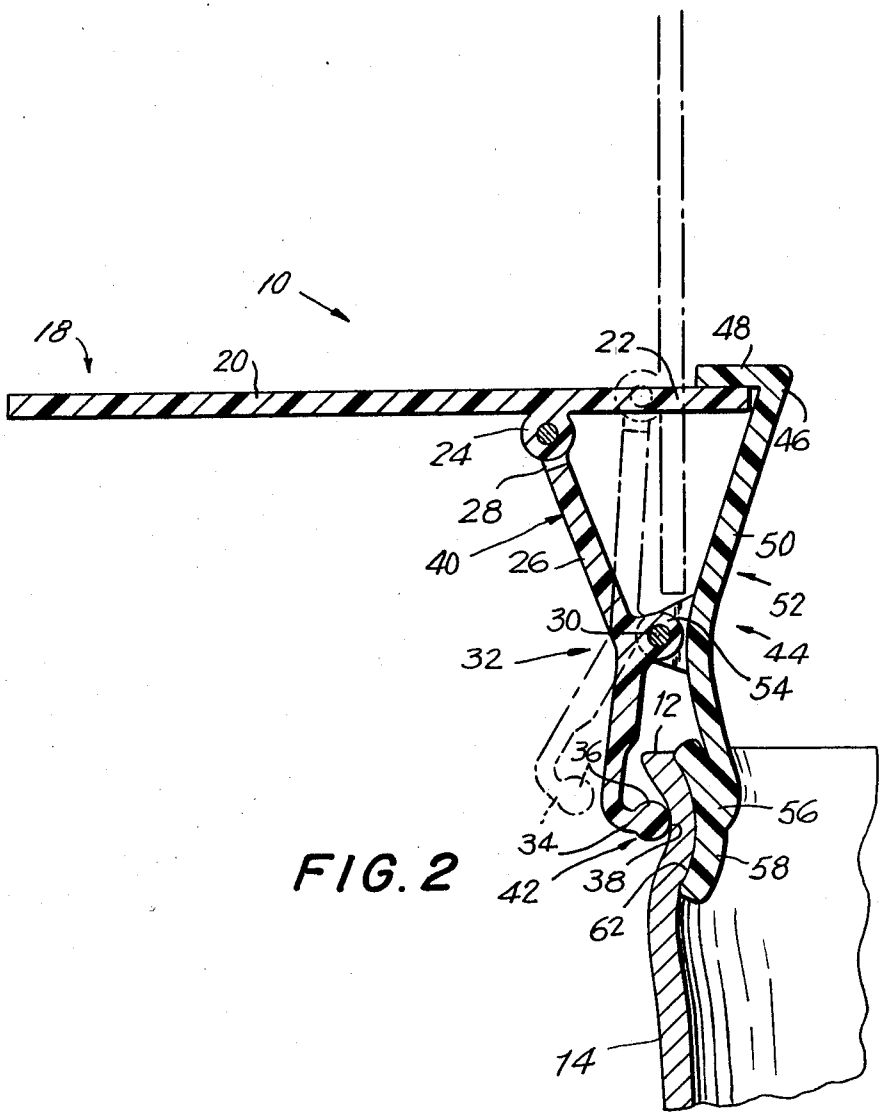
FIG. 2 is a sectional view along lines 2—2 of FIG. 1.

FIGS. 1 and 2 will now be described. The gripper comprises a handle 18 of a T-shape having a leg 20 and a head 22. The handle has a hinge connection 24 approximately at its mid-point, with the hinge connection 24 depending downwardly from the leg 20 of the T-shape handle 18. A first jaw member 26 has its top end 28 hingedly connected to handle 18 at hinge 24 and has a second hinge connection 30 approximately at its mid-point 32. Hinge 30 extends toward the head 22 of the handle 18. The bottom end 34 of the first jaw 26 also extends in the same direction as does hinge 30, and the bottom end terminates in a rounded tip 36. The rounded tip 36 has a convex front bearing surface 38 which is adapted to bear against the top edge 12 of the boot 14. The first jaw also is of a T-shape, with the leg 40 of the T hingedly connected to the handle at hinge 24, while the bottom head 42 of the first jaw member flanks the T to provide a wide bearing surface 38.

A second jaw member 44 is provided opposite the first jaw member 26, and the second jaw member comprises a top end 46 having a bend or fold 48. The top end extends then downwardly to the leg 50 of the T-shaped second jaw 44, with the upper segment 52 of the second jaw tapered inwardly toward the first jaw. A hinge 54 is integrally formed as part of the second jaw member 44 and is connected with the hinge 30 allowing the jaws to move toward and away from each other. The bottom end 56 of second jaw 44 also comprises the head of a T 58 and comprises a concave receiving surface 62 against which the surface 12 of the boot is urged by tip 36 of the first jaw member 26.

The assisting operation of the boot clamp will now be described. The user uses his fingers to grap the side edges of the boot to position the foot in the boot. The clamp is then attached to the rear of the boot. This is accomplished as follows: The leg 20 of handle 18 is moved upwardly to a release position which frees tip 36 from concave surface 62 of the second jaw. The top edge or surface 12 of the boot 14 is slid between the opposite bearing surfaces 38 and 62. Once in this position, the leg 20 of the handle serves as a lever and is pushed downwardly to a tightened position which draws the head 22 against the upper stop of second jaw member 44. The distance between hinge 24 and the head 22 of the handle is so arranged such that as the handle is moved downwardly to its tightened position, the head forms a bearing surface bearing against the upper section of the second jaw and causes a spring-like tension to be exerted on the opposite gripping or bearing surfaces 38 and 62. Thus, the lever or leg 20 is pushed or urged downwardly as the head 22 of the handle bears against the surface of the second jaw. As this occurs, there is a tightening exerted at the distal ends of the first and second jaw members, allowing the boot surface captured therebetween to be securely held by the boot gripper. In a sense, the head 22 snaps into this stop formed in the second jaw, and a spring-leaf type tension is caused to be exerted on the gripping surfaces of the first and second jaw members.

The components of the gripper may be formed of metal or may be molded of plastic. In either case, the components are light in weight, durable and allow the boot gripper to be compact, easily stored yet inexpensive to manufacture and susceptible of a wide spread use.

This invention has been described with regard to a preferred embodiment, other embodiments may be developed by those skilled in the art which will come within the teachings of this invention.

I claim:

1. A gripper assisting in pulling boots on the foot of a user, said gripper comprising a handle comprising a forward bearing surface and a mid-point hinge connection, said handle comprising a T with the leg of the T being pushed downwardly by the user while the head is moved upwardly a first jaw member hingedly connected at the extremity of one end to said mid-point hinge connection, the other end of said jaw member comprising a gripping surface a second jaw member having a front bearing surface at one end thereof and a stop cooperating with the forward bearing surface of said handle, said second jaw member comprising a gripping surface located opposite to the gripping surface of said first jaw member, said first and second jaw members being hingedly joined together at their respective mid-points, said handle being movable from a first vertical position in which said gripping surfaces are spaced apart sufficiently to permit the top end of a boot to be inserted therebetween to a second horizontal position in engagement with said stop in which the top end of said boot is gripped by said gripping surfaces, said bearing surface of said handle moving against the bearing surface of said second jaw member as said handle is forced to the horizontal position to hold said boot, the bearing surface of said handle being maintained in tension against the bearing surface of said second jaw member when the shoe is held between said gripping surfaces.

2. A gripper as set forth in claim 1, wherein said gripping surface of said first jaw member comprises a rounded tip projected into the boot area to be gripped.

3. A gripper as set forth in claim 2, wherein the gripping surface of said second jaw member terminates in a concave surface into which said gripped boot surface is pressed and held by said tip of said first jaw member.

4. A gripper as set forth in claim 1, wherein said handle and said first and second jaw members are formed of metal.

5. A gripper as set forth in claim 1, wherein said handle and said first and second jaw members are molded of plastic.

6. A gripper as set forth in claim 1, wherein the head of said forms said forward bearing surface.

7. A gripper as set forth in claim 6, wherein said stop of said second jaw member comprises a plate having an upper inward bend forming a stop for said head of said an inwardly tapered upper segment forming said front bearing surface against which said head moves and is maintained under tension when the boot is inserted and held by said first and second jaw members.

* * * * *